US008882350B2

(12) United States Patent
Cheney

(10) Patent No.: US 8,882,350 B2
(45) Date of Patent: Nov. 11, 2014

(54) LAWN CARE LEAF AND DEBRIS COLLECTION SYSTEM

(76) Inventor: Darrell Lee Cheney, Acworth, GA (US)

( * ) Notice: Subject to any disclaimer, the term of this patent is extended or adjusted under 35 U.S.C. 154(b) by 5 days.

(21) Appl. No.: 13/481,844

(22) Filed: May 27, 2012

(65) Prior Publication Data

US 2013/0315509 A1 Nov. 28, 2013

(51) Int. Cl.

| | |
|---|---|
| ***B65D 33/28*** | (2006.01) |
| ***B65D 33/00*** | (2006.01) |
| ***B65D 33/01*** | (2006.01) |
| ***B65B 67/04*** | (2006.01) |

(52) U.S. Cl.
USPC ..... 383/75; 383/33; 383/102; 248/99

(58) Field of Classification Search
USPC ..... 383/75, 100, 102, 130, 33–34.1, 36, 383/105, 103; 248/99; 241/285.2
See application file for complete search history.

(56) References Cited

U.S. PATENT DOCUMENTS

| | | | | |
|---|---|---|---|---|
| 3,492,800 | A * | 2/1970 | Peterson et al. | 56/202 |
| 5,031,277 | A * | 7/1991 | Coker | 15/257.3 |
| 5,213,141 | A * | 5/1993 | Dorman | 141/10 |
| 5,393,022 | A * | 2/1995 | Palumbo | 248/95 |
| 6,082,574 | A * | 7/2000 | Johnson | 220/495.1 |
| 6,135,637 | A * | 10/2000 | Kim | 383/103 |
| 6,151,875 | A * | 11/2000 | Collins | 56/202 |
| 6,155,522 | A * | 12/2000 | Anderson | 248/99 |
| 6,988,293 | B2 * | 1/2006 | Ritter | 15/347 |
| 7,490,787 | B1 * | 2/2009 | Salazar | 241/62 |
| 7,806,593 | B2 * | 10/2010 | Toporski | 383/33 |
| 7,815,153 | B2 * | 10/2010 | Campbell et al. | 248/99 |
| 2002/0100844 | A1 * | 8/2002 | Green | 248/99 |
| 2003/0173471 | A1 * | 9/2003 | Weathers et al. | 248/99 |
| 2005/0025397 | A1 * | 2/2005 | Zhao | 383/102 |
| 2007/0157424 | A1 * | 7/2007 | Mottahedeh | 15/405 |

* cited by examiner

*Primary Examiner* — Jes F Pascua

(57) ABSTRACT

The present invention is a lawn care and collection system that includes a disposable plastic air gill bag that receives leaves and yard debris preferably air blown or manually raked to be collected, contained and disposed of. It includes gill columns disposed on the air gill bag that provide controlled air flow and ventilation, tie string ports and vertical strength columns. A pair of air curtains is removably attached to a pair of single rod vertical supports via a sewn sleeve to one rod of double rod vertical supports that are removably and adjustably secured to an air curtain. The air gill bag is removably and adjustably connected to a second rod of the double rod vertical supports through the incorporated tie string ports on both sides of the air gill bag.

8 Claims, 2 Drawing Sheets

LAWN CARE LEAF AND DEBRIS COLLECTION SYSTEM

TECHNICAL FIELD & BACKGROUND

Traditional methods of leaf collecting include manually picking up debris or using a device which employs a cloth collection bag. Currently there are limited alternatives to products that can simplify this common act of land and lawn maintenance while supporting independent productivity.

The present invention generally relates to a lawn care system. More specifically, the invention is a lawn care leaf and debris collection system.

It is an object of the invention to provide a lawn care leaf and debris collection system that utilizes an air gill bag and directional air curtain.

It is an object of the invention to provide a lawn care leaf and debris collection system that utilizes a disposable collection bag with a leaf blower or other suitable debris blowing device.

It is an object of the invention to provide a lawn care leaf and debris collection system that can be operated exclusively by one person if needed.

What is really needed is a lawn care leaf and debris collection system that utilizes an air gill bag functioning as a disposable collection bag in combination with a directional air curtain with a leaf blower that can be operated exclusively by one person if needed.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the multiple applications. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

Figure 1A:
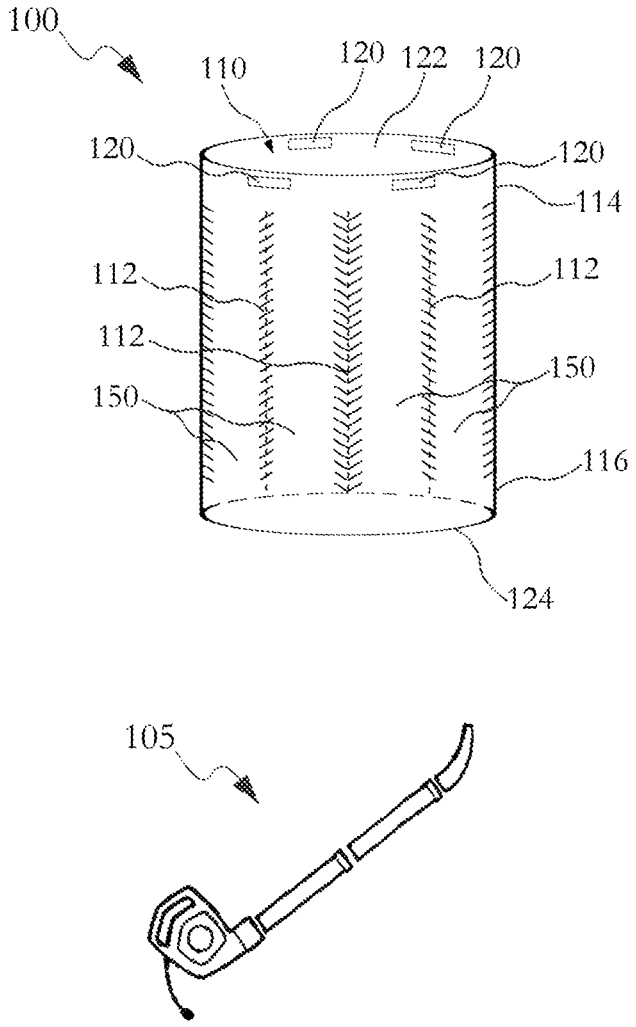
FIG. 1A illustrates a side view of an air gill bag of a lawn care leaf and debris collection system, according to an embodiment of the present invention.

FIG. 1A illustrates a side view of an air gill bag 110 of a lawn care leaf and debris collection system 100, according to an embodiment of the present invention. The lawn care leaf and debris collection system 100 includes the air gill bag 110, a plurality of tie string ports 120 and a plurality of strength columns 150. The air gill bag 110 receives a plurality of leaves, yard debris and other types of suitable debris for collection and containment to be disposed. The air gill bag 110 is disposable and is made of plastic or any other suitable material and is typically positioned in a horizontal position to receive and contain the previously described leaves, yard debris and other types of suitable debris that might be blown into the air gill bag 110 to fully and completely fill the air gill bag 110. However the air gill bag 110 can be positioned in an upright vertical position to receive and contain the previously described leaves, yard debris and other types of suitable debris from a user dumping or pouring the previously described leaves, yard debris and other types of suitable debris into the air gill bag 110. The air gill bag 110 includes a plurality of gill cut columns 112 disposed on both sides of the air gill bag 110 that provide controlled air flow and ventilation while the lawn care leaf and debris collection system 100 is being used. The air gill bag 110 also has an approximate 3 inch exterior smooth area 114 disposed around the gill cut columns 112 and an approximate 5 inch exterior smooth area 116 disposed below the gill cut columns 112 if needed can increase a volume of ventilation for a relatively large blower 105. The tie string ports 120 are disposed on a top portion 122 of the air gill bag 110 and are described in more detail in FIG. 1B and its illustration and description. The strength columns 150 are vertical on both sides of the air gill bag 110 and provide additional strength and support to the air gill bag 110.

The lawn care leaf and debris collection system 100 can be placed horizontally onto a ground surface (not shown) or other suitable surface. Previously described leaves, yard debris and other types of suitable debris can be raked, shoveled or blown into the air gill bag 110 of the lawn care leaf and debris collection system 100. Previously described leaves, yard debris and other types of suitable debris can also be blown into the air gill bag 110 with a leaf blower 105 or other suitable debris blowing device.

Figure 1B:
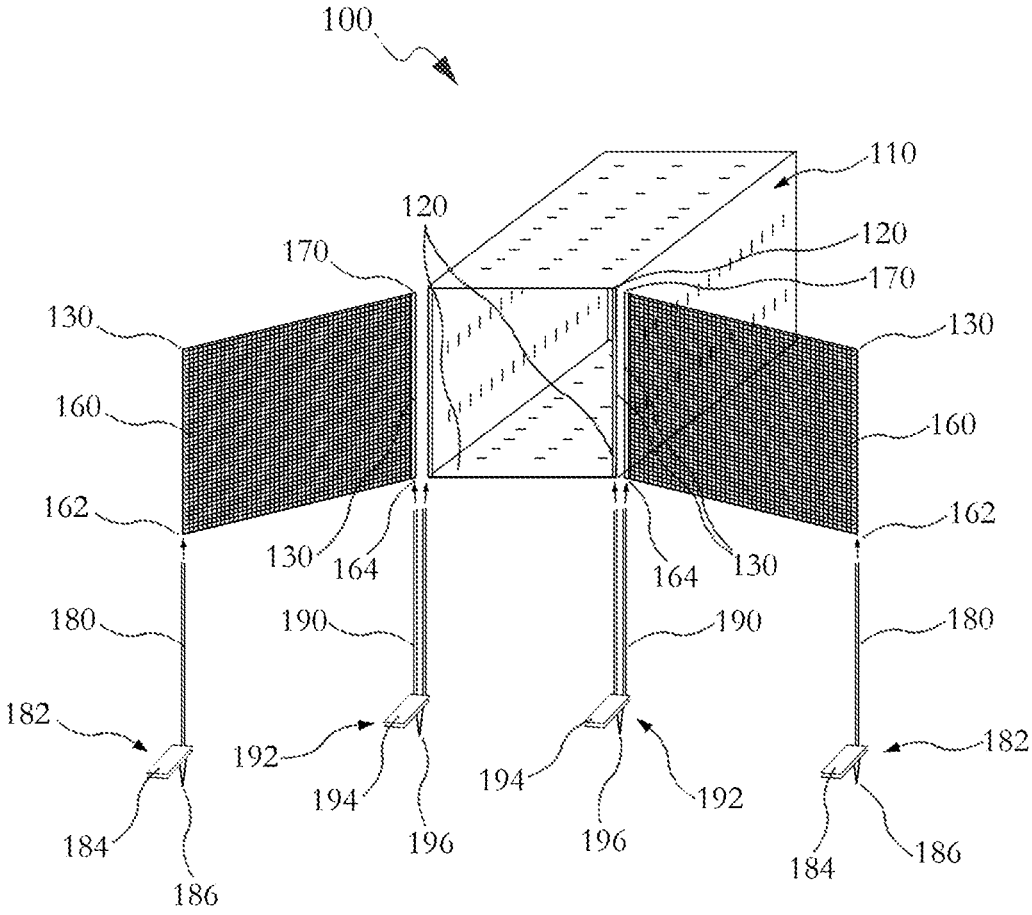
FIG. 1B illustrates a front view of a directional curtain used in combination with a horizontally positioned air gill bag of a lawn care leaf and debris collection system, according to an embodiment of the present invention.

FIG. 1B illustrates a front view of a pair of directional curtains 160 used in combination with an air gill bag 110 of a lawn care leaf and debris collection system 100, according to an embodiment of the present invention. The lawn care leaf and debris collection system 100 has all of the similar elements described and illustrated in FIG. 1A and its description that include the air gill bag 110, a plurality of tie string ports 120 and a plurality of strength columns 150. The lawn care leaf and debris collection system 100 also includes a pair of air curtains 160, a plurality of tie string ports 120 that are part of the air gill bag 110, a pair of single rod vertical supports 180 and a pair of double rod vertical supports 190. The pair of air curtains 160 are removably attached to one rod of the double rod vertical supports 190 and the other end of the single rod vertical support 180 of the air gill bag 110. The tie string ports 120 are removably attached to the tie string ports 120 (FIG. 1A) forming the removable attachment of the air gill bag 110 and the pair of air curtains 160 via the double rod vertical supports 190. The single rod vertical supports 180 are slid into sewn sleeve at the distal end bottom 162 of the pair of air curtains 160 onto the double rod vertical support 190. The single rod vertical supports 180 have a distal end 182 where a horizontal plate 184 and a spike 186 are disposed. The spike 186 is typically approximately 6 inches long but can be any suitable length. The horizontal plate 184 limits the distance the distal end 182 of the single rod vertical supports 180 can go into the ground surface. The pair of double rod supports 190 is attached to the proximal end bottom 164 of the pair of air curtains 160. The pair of double rod supports 190 is slid in a sleeve 130 and is removably and adjustably secured within the sleeve 130. The double rod vertical supports 190 have a distal end 192 where a horizontal plate 194 and a spike 196 are disposed. The spike 186 is typically approximately 6 inches long but can be any suitable length. The horizontal plate 194 limits the distance the distal end 192 of the double rod vertical supports 190 can go into the ground surface. Both the single rod vertical supports 180 and the double rod vertical supports 190 secure the pair of air curtains 160 and the air gill bag 110 in a secured and set position to form an opening for the previously described leaves, yard debris and other types of suitable debris to enter into the air gill bag 110.

The lawn care leaf and debris collection system is designed to be utilized with or without an air blower that introduces a method for gathering leaves and other debris. The lawn care leaf and debris collection system includes a disposable bag, manufactured with a plurality of slit and perforated cuts defined as gills and incorporates a pair of side fenced air curtains that are removably connected to the primary centered air gill bag by two single and two double rod anchor stakes that slide through sewn sleeves at each curtain end and tie string ports on each side of the air gill bag. The lawn care leaf and debris collection system functions as a stationary air controlling system, grounded by a plurality of 6-inch spiked plates at the base of each anchor stake, allowing for stability and consistency as an air blower forces leaves and debris into the system. The lawn care leaf and debris collection system permits in-coming air to pass through the gills leaving only the remains securely inside the air gill bag, thus alleviating the necessity of raking or bagging leaves. The lawn care leaf and debris collection system may be readily available wherever lawn and garden supplies can be found. The lawn care leaf and debris collection system is a product which utilizes strength columns paralleled to a plurality of gill cuts that enables the air gill bag to maintain integrity regardless of an amount of debris volume or force. The feature of a leaf collecting system can also include the lawn care leaf and debris collection system, a branded blower as well as a coupon which empowers the customer to order to secure an initial supply of air gill bags for specific use with their preferred blower and affords users with a practical and economically friendly method to perform an otherwise arduous task or for a manufacturer to avoid including air gill bags that are not adaptable to a preferred blower.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A lawn care leaf and debris collection system, comprising:

a disposable plastic air gill bag with a top portion and a bottom portion that receives a plurality of leaves and yard debris to be collected and contained to be disposed of, wherein said air gill bag includes a plurality of gill columns disposed on said air gill bag that provide controlled airflow and ventilation while said lawn care leaf and debris collection system is being used;

a plurality of tie string ports integral in the top portion of said air gill bag;

a pair of air curtains each with a distal end bottom and a proximal end bottom and that are configured to removably attach to said air gill bag;

a pair of single rod vertical supports with a distal end that are slid through to said distal end bottom of one of said pair of air curtains; and a pair of double rod vertical supports with a distal end that are slid into said proximal end bottom of one of said pair air curtains; and wherein said plurality of tie string ports receive said pair of double rod vertical supports, thereby forming the removable attachment of the air gill bag and the pair of air curtains via the pair of double rod vertical supports.

2. The system according to claim 1, wherein said air gill bag has an approximate 3 inch exterior smooth area disposed on the surface of the air gill bag above said gill columns to provide increased airflow.

3. The system according to claim 1, wherein said air gill bag has an approximate 5 inch exterior smooth area disposed on the surface of the air gill bag below said gill columns to provide increased airflow.

4. The system according to claim 1, wherein said single rod vertical supports are slid into a sleeve and are removably and adjustably secured within said sleeve.

5. The system according to claim 1, wherein a horizontal plate and a spike are disposed on said distal end of said pair of double rods.

6. The system according to claim 5, wherein said spike is approximately 6 inches long.

7. The system according to claim 1, wherein said single rod vertical supports and said double rod vertical supports secure said pair of air curtains in a secured and set position.

8. The system according to claim 1, wherein said double rod vertical supports secure said air gill bag in a secured and set position.

* * * * *